US006629531B2

(12) United States Patent
Gleason et al.

(10) Patent No.: US 6,629,531 B2
(45) Date of Patent: Oct. 7, 2003

(54) RESPIRATORY MASK AND SERVICE MODULE

(75) Inventors: Colin M. Gleason, Clarence, NY (US); Valentin A. Castro, Williamsville, NY (US)

(73) Assignee: Scott Technologies, Inc., Beachwood, OH (US)

( * ) Notice: Subject to any disclaimer, the term of this patent is extended or adjusted under 35 U.S.C. 154(b) by 0 days.

(21) Appl. No.: 09/836,425

(22) Filed: Apr. 17, 2001

(65) Prior Publication Data

US 2001/0035188 A1 Nov. 1, 2001

Related U.S. Application Data

(60) Provisional application No. 60/197,762, filed on Apr. 17, 2000.

(51) Int. Cl.[7] ..... A62B 18/02

(52) U.S. Cl. ..... 128/205.25; 128/206.24; 128/206.26

(58) Field of Search ..... 128/205.25, 206.15, 128/206.21, 206.24, 206.26, 207.12, 201.19, 202.27, 207.11

(56) References Cited

U.S. PATENT DOCUMENTS

| | | | | | |
|---|---|---|---|---|---|
| 1,362,766 | A | | 12/1920 | McGargill | 128/206.24 |
| 1,653,572 | A | * | 12/1927 | Jackson | 128/206.24 |
| 2,371,965 | A | * | 3/1945 | Lehmberg | 128/205.25 |
| D143,782 | S | | 2/1946 | Yant | D83/1 |
| 2,444,417 | A | * | 7/1948 | Bierman | 128/201.19 |
| 2,465,973 | A | | 3/1949 | Bulbulian | 128/141 |
| 2,473,518 | A | | 6/1949 | Garrard et al. | 128/142 |
| 2,505,173 | A | | 4/1950 | Conley | 128/141 |
| 2,629,375 | A | | 2/1953 | Holmes | 128/140 |
| 2,954,027 | A | | 9/1960 | Marasco | 128/195 |
| 2,985,169 | A | | 5/1961 | Elling | 128/142 |
| 3,056,402 | A | * | 10/1962 | Dickinson | 128/207.11 |
| 3,092,105 | A | | 6/1963 | Gabb | |
| 3,256,898 | A | | 6/1966 | Ringrose | 137/64 |
| 3,330,273 | A | * | 7/1967 | Bennett | 128/206.26 |
| 3,459,216 | A | | 8/1969 | Bloom et al. | 137/512.1 |

(List continued on next page.)

FOREIGN PATENT DOCUMENTS

GB 1072741 * 6/1967

*Primary Examiner*—Aaron J. Lewis
(74) *Attorney, Agent, or Firm*—Hodgson Russ LLP

(57) ABSTRACT

A respiratory mask and service module combination for pressure breathing. The respiratory mask has a hardshell member that extends along the contour of the face toward the peripheral edge of the mask and has a central portion forming a canopy. An inhalation/exhalation valve assembly having two breathing conduits and integrally formed so as to provide communication between the conduits. The assembly mounts externally to the mask such that the valves are capable of being sealed along the outer surface of the respiratory mask. It is emphasized that this abstract is provided to comply with the rules requiring an abstract that will allow a searcher or other reader to quickly ascertain the subject matter of the technical disclosure. It is submitted with the understanding that it will not be used to limit the scope or meaning of the claims. 37 C.F.R. 1.72(b).

29 Claims, 11 Drawing Sheets

U.S. PATENT DOCUMENTS

| | | | | | |
|---|---|---|---|---|---|
| 3,602,219 | A | | 8/1971 | Warncke | 128/146.5 |
| 4,062,357 | A | * | 12/1977 | Laerdal | 128/206.26 |
| 4,111,197 | A | | 9/1978 | Warncke et al. | 128/142.4 |
| 4,164,942 | A | * | 8/1979 | Beard et al. | 128/207.12 |
| 4,250,877 | A | | 2/1981 | Owens et al. | 128/207.11 |
| D266,196 | S | | 9/1982 | Sundström | D29/8 |
| 4,402,316 | A | | 9/1983 | Gadberry | 128/201.15 |
| 4,559,939 | A | * | 12/1985 | Levine et al. | 128/205.25 |
| 4,574,799 | A | | 3/1986 | Warncke | 128/206.24 |
| 4,677,977 | A | | 7/1987 | Wilcox | 128/206.24 |
| 4,739,755 | A | | 4/1988 | White et al. | 128/206.12 |
| 4,770,169 | A | | 9/1988 | Schmoegner et al. | 128/206.24 |
| D303,585 | S | | 9/1989 | White et al. | D29/7 |
| 4,905,683 | A | | 3/1990 | Cronjaeger | 128/202.22 |
| 4,957,106 | A | | 9/1990 | Vandeputte | 128/201.19 |
| 4,960,121 | A | | 10/1990 | Nelson et al. | 128/206.24 |
| 4,961,420 | A | | 10/1990 | Cappa et al. | 128/207.12 |
| 4,991,577 | A | | 2/1991 | Shigematsu | 128/207.12 |
| 5,003,633 | A | * | 4/1991 | Itoh | 128/206.24 |
| 5,080,092 | A | | 1/1992 | Tenna | 128/201.19 |
| 5,265,595 | A | | 11/1993 | Rudolph | 128/204.18 |
| 5,271,390 | A | | 12/1993 | Gray et al. | 128/207.12 |
| 5,297,544 | A | | 3/1994 | May et al. | 128/202.22 |
| 5,318,019 | A | * | 6/1994 | Celaya | 128/205.25 |
| 5,419,318 | A | | 5/1995 | Tayebi | 128/205.27 |
| 5,499,624 | A | | 3/1996 | Kruger et al. | 128/204.26 |
| 5,540,223 | A | | 7/1996 | Starr et al. | 128/205.25 |
| 5,572,990 | A | | 11/1996 | Berlin | 128/201.19 |
| D377,089 | S | | 12/1996 | Starr et al. | D24/110.1 |
| 5,647,357 | A | | 7/1997 | Barnett et al. | 128/206.24 |
| 5,673,690 | A | | 10/1997 | Tayebi et al. | 128/206.24 |
| 5,676,133 | A | * | 10/1997 | Hickle et al. | 128/205.25 |
| 5,775,323 | A | * | 7/1998 | Knott | 128/202.27 |
| 5,787,882 | A | | 8/1998 | Hamilton | 128/204.26 |
| 5,839,436 | A | | 11/1998 | Fangrow, Jr. et al. | 128/205.24 |
| 5,924,420 | A | * | 7/1999 | Reischel et al. | 128/206.21 |
| 6,039,043 | A | * | 3/2000 | Graber et al. | 128/202.27 |

* cited by examiner

RESPIRATORY MASK AND SERVICE MODULE

CROSS-REFERENCE TO RELATED APPLICATION

Applicant hereby claims priority based on U.S. Provisional Application No. 60/197,762 filed Apr. 17, 2000, entitled "Respiratory Mask With a Modular Inhalation/Exhalation Valve Assembly" which is incorporated herein by reference.

FIELD OF THE INVENTION

This invention relates to respiratory masks and service modules suitable for use in pressure breathing and other applications.

BACKGROUND OF THE INVENTION

High performance, high altitude flying typically poses several challenges for masks for pressure breathing. First, high mask pressures make it relatively difficult to hold the mask on the face with minimal leakage. Second, the "G" forces combined with the harnessing and mask pressures tend to cause discomfort for the user. Third, "G" forces sometimes cause the mask to lose proper position and to migrate around the face.

Because of the environment that the mask assembly is subjected to, namely the pressure differential in high altitude applications and the forces associated with High "G" force applications, it is desirable to minimize the volume of the internal breathing cavity. A larger breathing gas cavity where pressure is higher than ambient would create greater forces urging the mask away from the face of the user thus requiring tighter restraints to keep the mask on the face.

Accordingly there is a need for an oro-nasal mask that minimizes the surface area "footprint" of the mask internal breathing cavity on the face.

With any pressure breathing mask, some force needs to be exerted on the face to counteract pressure forces and for harnessing. It is important to exert this force in a fashion so that it is not localized or causing pressure points on isolated areas such as the bridge of the nose.

Also, because varying "G" loads and directions will magnify any mask weight and attempt to pull it around the face there is a need for a mask design that is structurally supported on the face so as to be resistant to being pulled around the face.

Further, in order to provide a proper seal for different face sizes and face shapes, it is often desirable to provide an arrangement so that breathing conduits or the like can be easily and quickly combined with more than one size mask.

In addition to the high altitude, high performance setting, the modular design would also be important to many other types of masks including, but not limited to, full facepiece masks, standard half facepiece masks, half facepiece masks with detachable goggles, or the like.

SUMMARY OF THE INVENTION

The present invention meets the above-described need by providing a respiratory mask and service module combination.

The mask provides a modular arrangement such that the service module can be used with many different sized mask assemblies.

The service module is described herein in connection with a mask assembly suitable for high "G" force applications.

However, as it will be apparent to those of ordinary skill in the art, the service module could also be integrated into modular designs for other types of masks including, but not limited to, full facepiece masks, standard half facepiece masks, half facepiece masks with detachable goggles, or the like.

Also, in order to provide a proper seal for different face sizes and face shapes, it is often desirable to provide more than one size mask. The present invention provides for interchanging different mask assemblies with a single service module.

BRIEF DESCRIPTION OF THE DRAWINGS

The invention is illustrated in the drawings in which like reference characters designate the same or similar parts throughout the figures of which.

DETAILED DESCRIPTION

Figure 1:
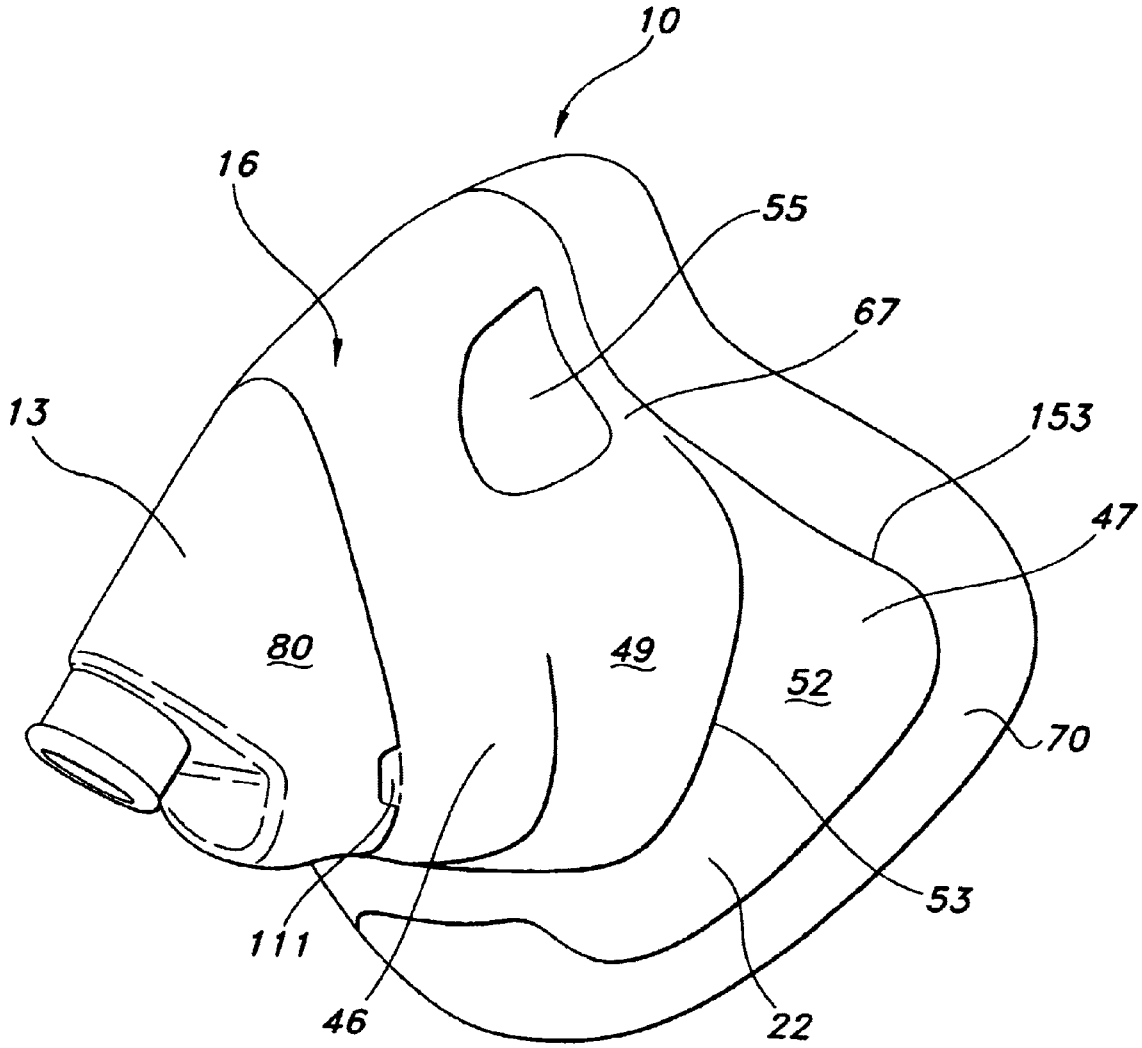
FIG. 1 is a perspective view of the respiratory mask and inhalation/exhalation valve assembly of the present invention.
Figure 2:
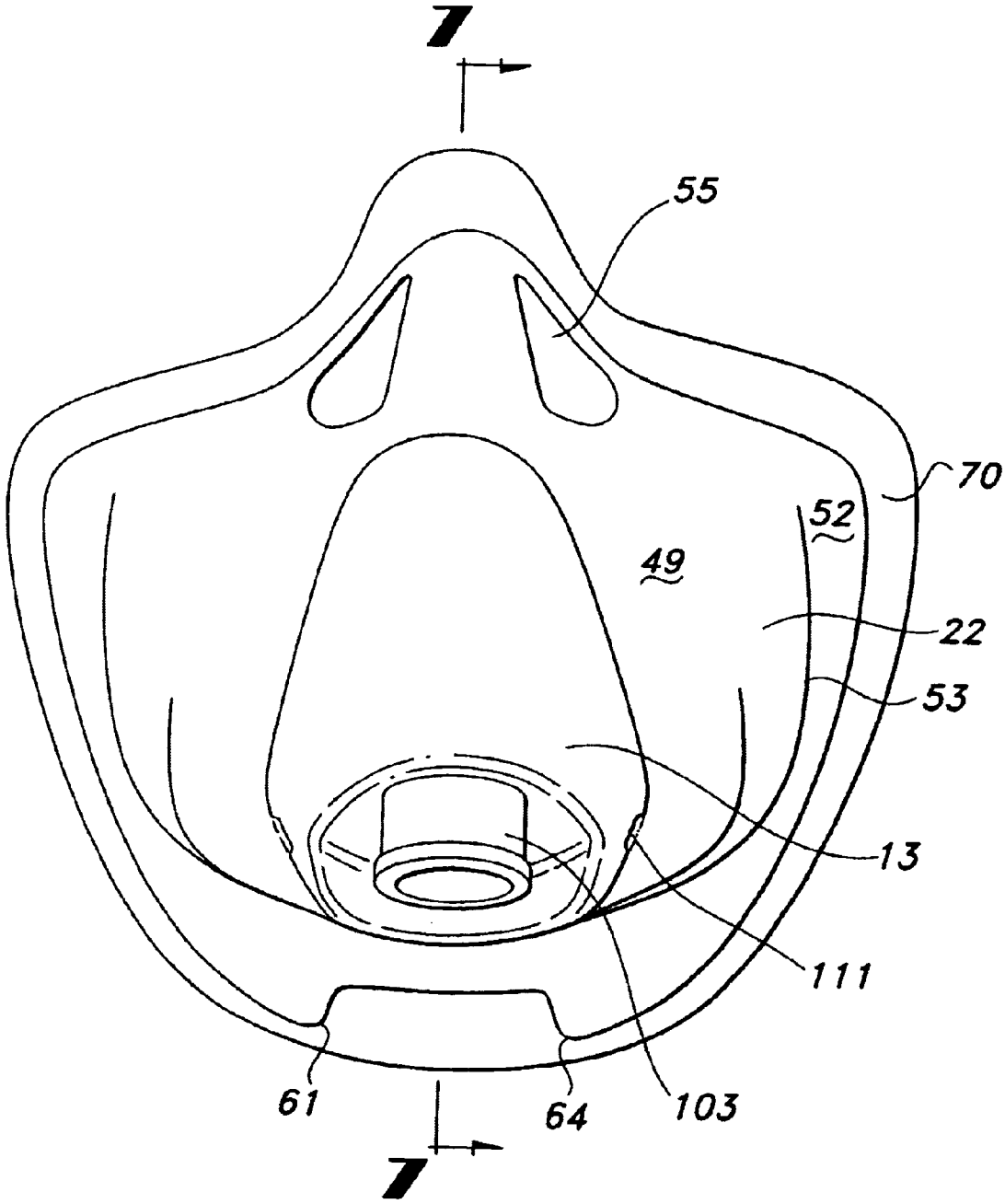
FIG. 2 is a front elevational view of the respiratory mask and inhalation/exhalation valve assembly of the present invention.
Figure 3:
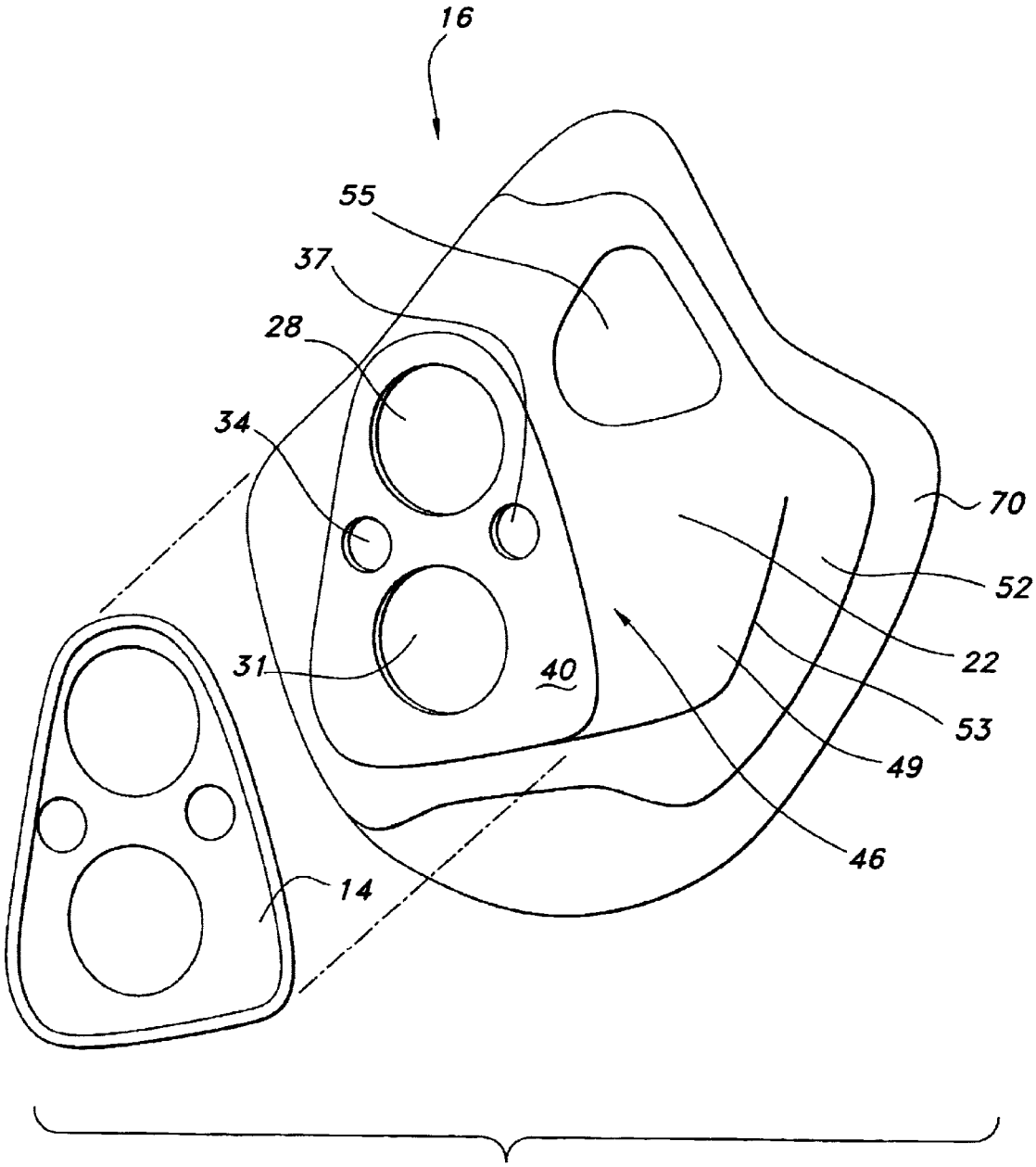
FIG. 3 is a perspective view of the half facepiece mask of the present invention with the inhalation/exhalation valve assembly removed.

Referring initially to FIGS. 1 and 2, a half facepiece respiratory mask 10 includes an inhalation/exhalation valve assembly 13 and a half facepiece mask assembly 16. The inhalation/exhalation valve assembly 13 of the present invention is one form of a service module. The term "service module" is defined as a module having at least two or more conduits and designed so as to provide communication between at least two of the conduits. In the example shown, the service module is an inhalation/exhalation valve assembly. Other service applications requiring two conduits and integrally formed so as to provide communication therebetween are also part of the invention. Another example is a communications device in electrical communication with the inhalation or exhalation valve. In the embodiment shown, the valve assembly 13 is removably attached to the mask assembly 16 as described below and the valve assembly 13 is capable of being sealed with a single gasket 14 (FIG. 3). The mask 10 provides for a modular arrangement such that the inhalation/exhalation valve assembly 13 can be used with different sized mask assemblies 16. The inhalation/exhalation valve assembly 13 is preferably contained in a single housing 80. The mask assembly 16 is a half facepiece with a relatively rigid plastic hardshell member 22 having an elastomeric material 25 bonded thereto. The valve assembly 13 is described herein in connection with a mask assembly 16 suitable for high "G" force applications, however, as it will be apparent to those of ordinary skill in the art, the valve assembly 13 could also be integrated into modular designs for other types of masks including but not limited to full facepiece masks, standard half facepiece masks, half facepiece masks with detachable goggles, or the like.

The mask 10 has an inlet 103 for connection to a breathing gas tube and an outlet 108 (FIG. 10) leading to an exhalation port 111 for exhalation. The mask 10 can be provided with additional openings 34, 37 for microphones, drink tubes, anti-suffocation valves, or the like as shown in FIG. 3. Also, the mask 10 can be equipped with a single opening to receive the inhalation and exhalation conduits or a single opening for a pair of conduits arranged so as to have concentric passageways for inhalation and exhalation gases as known to those of ordinary skill in the art.

Turning to FIG. 3, the half facepiece mask assembly 16 has an opening 28 for the inhalation valve, an opening 31 for the exhalation valve, and a pair of auxiliary openings 34 and 37, which can be used for drink tubes, anti-suffocation valves and the like as mentioned above. The openings are all disposed on a substantially planar portion 40 that is integrally formed in the hardshell member 22. The planar portion 40 is described in greater detail hereafter.

Figure 6:
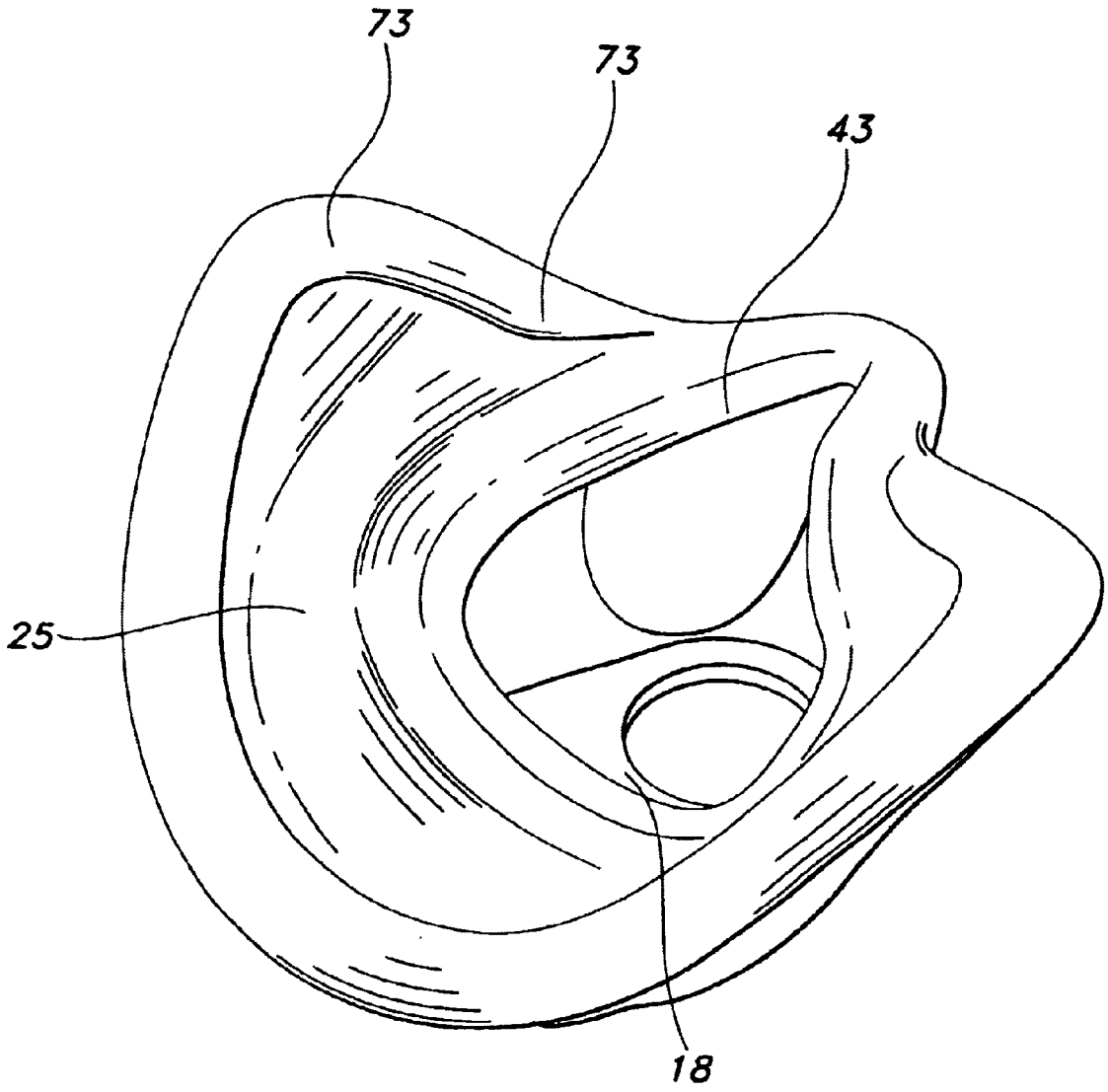
FIG. 6 is a perspective view of the inside of the half facepiece respiratory mask.

The hardshell member 22 is preferably an injection molded ABS. Suitable plastic materials include polycarbonate, polysulfone, and other thermoset plastics or thermoplastics and the like capable of being molded into a relatively rigid plastic structure, and may include fillers and additives for additional properties such as color and the like as known to those of ordinary skill in the art. The hardshell member 22 is preferably relatively rigid compared to the elastomer material 25. The elastomeric material 25 covers most of the hardshell member 22 on the inside of the mask assembly 16 (as shown in FIG. 6) and is used wherever the mask contacts the skin of the wearer.

The elastomeric material 25 preferably comprises medium density silicone having a durometer of 50–70 shore A. However, other elastomers and the like would also be suitable such as any liquid injection molded or compression molded elastomer having suitable bonding and elastomeric material properties.

In order to make the half facepiece mask assembly 16 shown in FIG. 3, the hardshell member 22 is placed in a mold and the elastomeric material 25 is molded to the hardshell member 22 through primarily chemical bonding during the molding process with some additional support from mechanical bonding around the hardshell member 22.

The mask assembly 16 is designed such that a sealed chamber 18 (FIG. 6) capable of receiving pressurized breathing gas is formed inside a portion of the mask assembly 16. Because of the environment that the mask assembly 16 is subjected to, it is desirable to minimize the volume of this chamber 18. For example, the pressure differential in high altitude applications and the forces associated with High G force applications make it desirable to minimize the volume of the breathing gas chamber 18. A larger breathing gas chamber where pressure is higher than ambient would create greater forces urging the mask away from the face of the user thus requiring tighter restraints to keep the mask on the face. Also, when the pilot experiences high G forces, the pressure of the breathing gas may be automatically increased, and this additional pressure increases the above-described forces that urge the mask away from the wearer's face.

As shown in FIG. 6, the chamber 18 is sealed by a primary faceseal 43 that defines an area that is substantially less than the size of the entire inside area of the mask assembly 16. When the mask 10 is placed on a wearer's face, the primary faceseal 43 extends over the bridge of the nose, around the sides of the nose and mouth and across the mental protuberance to subdivide the inside of the mask assembly 16 into a relatively small chamber that is sealed to confine the breathing gas.

Returning to FIGS. 1–3, the hardshell member 22 of the mask assembly 16 has a shape that extends outward from the face to form a canopy 46 to define the volume inside the mask assembly 16 for receiving pressurized gases. The hardshell member 22 extends outward to form the canopy 46 and terminates in the planar portion 40 (FIG. 3). As described above, the planar portion 40 can be equipped with one or more openings for various purposes. The planar portion 40 and the openings provide a modular design such that a valve assembly 13 can be used with different size mask assemblies 16 or vice versa.

For example, in order to provide a proper seal for different face sizes and face shapes, it is often desirable to provide more than one size mask. The present invention provides for interchanging different mask assemblies 16 with a single inhalation/exhalation valve assembly 13.

Also, the arrangement of the openings and the design of the inhalation/exhalation valve assembly 13 as described in detail herein provide for easy attachment and sealing between the mask assembly 16 and the valve assembly 13.

The hardshell member 22 of the mask defines the boundaries of the canopy 46 and also extends beyond the canopy 46 and conforms to the shape of the wearer's face. The hardshell member 22 extends beyond the canopy 46 below and to the sides of the canopy 46. The extension of the hardshell member 22 is most prominent along the "wings" 47 or the portion conforming to the shape of the cheek of the wearer. "Wings" are defined herein as extended portions of the hardshell member 22 that extend beyond the canopy across the cheeks of the wearer and conform substantially to the curvature of the wearer's face.

The hardshell member 22 of the present invention has a first portion 49 that defines the canopy 46 and has a second portion 52 that extends around the canopy 46. The second portion 52 extends underneath the canopy 46 and around the sides of the canopy 46 to conform to the shape of the wearer's face. The second portion 52 terminates along a peripheral edge 153. The elastomeric material 25 continues past the edge 153. The hardshell member 22 also includes a cut out portion 55 that provides for access to the nose by the wearer. In the cut out portion 55, the hardshell member 22 is removed but the elastomeric material 25 remains. The hardshell member 22 surrounding the cutout portion 55 provides some additional support to the sealing area around the bridge of the nose.

Figure 4:
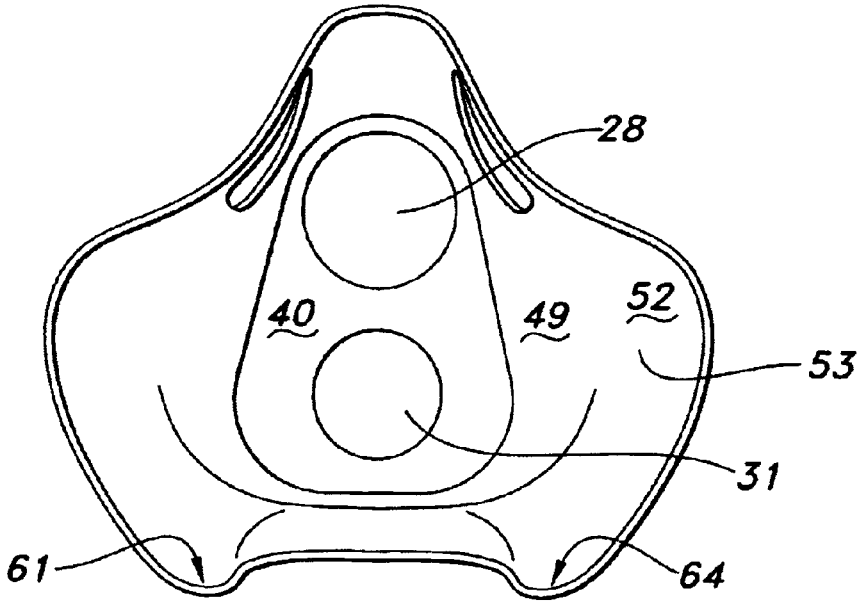
FIG. 4 is a front elevation of the hardshell subassembly for the half facepiece mask of the present invention.
Figure 5:
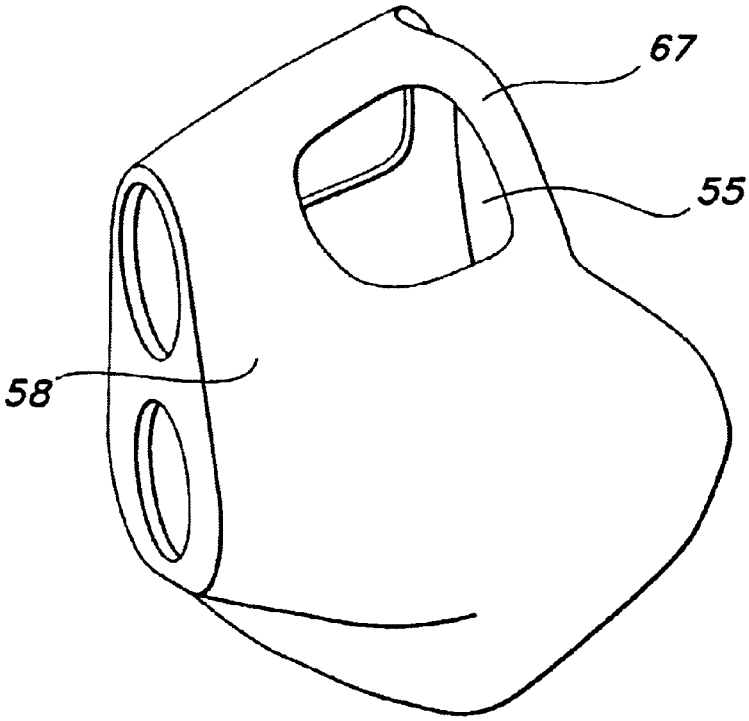
FIG. 5 is a perspective view of the hardshell subassembly for the half facepiece mask of the present invention.

In FIGS. 4 and 5, the hard shell portion 22 is shown with the inhalation opening 28 and exhalation openings 31 provided. As shown, the first portion 49 of the hardshell member 22 has a planar portion 40 that extends across the front of the canopy 46. The first portion extends from the planar portion 40 inward toward the wearer's face and terminates at the second portion 52. The transitions between the planar portion 40 and the side walls 58 of the first portion 49 are radiused to provide an aerodynamic design. At the junction 53 (best shown in FIGS. 1 and 4) between the first portion 49 and the second portion 52, the curvature of the hardshell member 22 changes relatively abruptly from a curve dictated by the first portion 49 defining a canopy 46 to the curvature of the second portion 52 which is dictated by the curvature of the wearer's face. The second portion 52 extends around the canopy 46 on the wearer's cheeks and extends to points 61 and 64 located on opposite sides of the wearer's chin.

The extension of the hardshell member 22 beyond the canopy 46 and along the curvature of the cheeks of the wearer provides several advantages including distribution of the forces associated with the retention system for the mask. Under high G force conditions and high altitude flying where the restraint system may pull the mask very tightly against the face, the distribution of the forces over a larger area provides for much greater comfort. If a mask has a small area of contact, the force is concentrated in that area and leads to discomfort.

In FIG. 5, the cut-out region 55 is shown. Part of the hardshell member 22 surrounding the cut-out region 55 includes a relatively thin strip of material 67 that, because it is made of the hardshell material is more rigid than the elastomeric material portion 25, and provides support to maintain the seal across the bridge of the nose. Because the material has some degree of flexibility and because of the curvature of the member 67 (best shown in FIG. 4) it functions similar to a spring that is pre-loaded such that it urges the elastomeric material 25 toward the face to keep the seal around the bridge of the nose.

In FIG. 6, the inside of mask assembly 16 is shown. As described previously, when the mask 10 is placed on the face of the wearer, a faceseal 43 extends around the bridge of the nose, down each side of the nose and mouth and across the mental protuberance. The faceseal 43 preferably comprises a reflective seal that bends to conform to the shape of the wearer's face. The space extending from the faceseal 43 to the front of the mask assembly 16 where the openings are located defines the intended breathing gas chamber.

A peripheral elastomeric section 70 (FIG. 1) of the elastomeric material 25 extends past the edge of the hardshell. Rolled edges 73 are shown along the cheeks and downward under the chin. The peripheral section 70 is not intended to define a pressurized gas chamber. The primary purpose of peripheral section 70 is to bear and to comfortably distribute the load on the wearer's face from the mask restraint/harness system. The peripheral section 70 also helps to maintain the proper alignment of the mask 10 on the wearer's face under high G force conditions. Peripheral section 70 may be provided with a rolled over edge 73 that provides additional padding so that the mask fits comfortably over the face. If the faceseal 43 is breached, the peripheral section 70 may also function to restrict the breathing gas from escaping from the inside of the mask 10. The peripheral section 70 may include a rollover edge 73 that is connected on the cheeks near the nose portion and that extends around the remainder of the perimeter of the mask assembly 16. The hardshell member 22 extends almost to the perimeter of the mask assembly 16 as described above. The elastomeric material 25 covers the inside of the hardshell member 22 along the portions of the hardshell that conform to the shape of the wearer's face to cushion the face and extends for a short distance beyond the edge of the hardshell member 22 at the perimeter of the mask for increased comfort. Accordingly, the mask transitions from an elastomeric covered hardshell portion conforming to the curvature of the wearer's face to a section of entirely elastomeric material extending around the perimeter of the mask. The hardshell member 22 and not the elastomeric material 25 is intended to provide the primary support to the mask assembly 16 along the cheek contours of the wearer's face. As an alternative, the elastomeric material 25 could be coextensive with the hardshell member 22 and therefore not extend beyond the hardshell periphery.

The peripheral section 70 and the mask assembly 16 conform to the shape of the wearer's chin such that the mask assembly 16 is substantially supported from the chin during use. The mask assembly 16 is designed such that the primary support and positioning of the mask is provided by the hardshell member 22 extending across the cheek portions and by the peripheral section 70 and the inside of the mask assembly 16 cradling the wearer's chin. As a result the restraint forces required for high altitude and high G force conditions are spread across a large area of the face and are concentrated across the width of the face and on the chin and lower jaw. In contrast, the portion of the mask that crosses the bridge of the nose is very well cushioned and is designed to seal with maximum comfort.

The elastomeric material 25 is bonded against the hardshell member 22 and extends approximately one-quarter to one-half of an inch beyond the edge of the hardshell member 22 around the perimeter of the mask. The extended portion of the elastomeric material 25 around the peripheral edge of the hardshell may terminate in the rollover edge 73. The elastomeric material 25 covers the hardshell member 22 on the inside of the mask and may provide a rollover edge 73 along the boundary defined by the peripheral section 70. However, the elastomeric material 25 primarily covers the hardshell member 22 which extends along the curvature of the wearer's face in the cheek regions to cushion it against the wearer's face. The peripheral section 70 also restrains the free flow of gas if the primary seal is breached.

Figure 7:
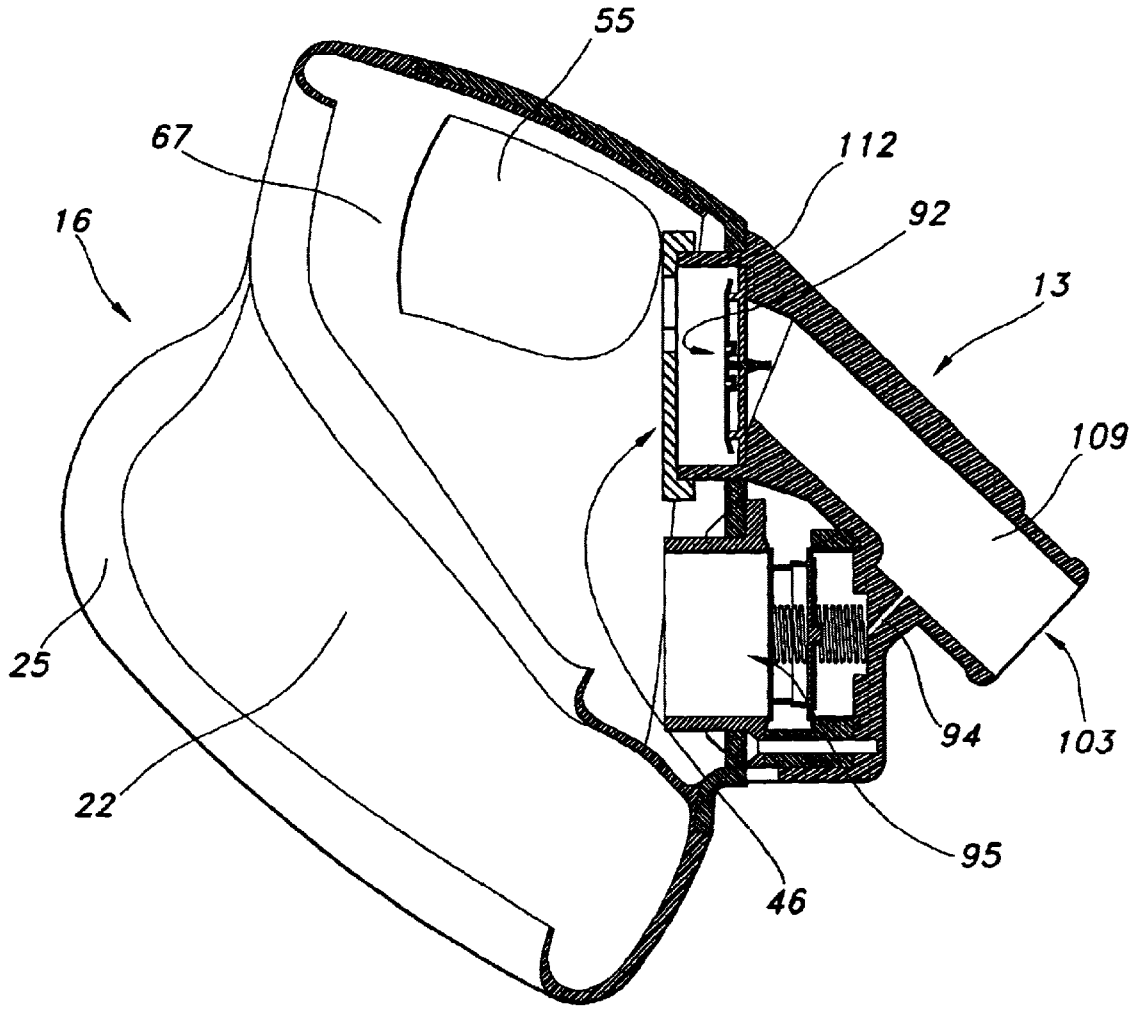
FIG. 7 is a sectional side view of the mask and inhalation/exhalation valve assembly taken along lines 7—7 of FIG. 2.

Turning to FIG. 7, one form of the service module is an inhalation/exhalation valve assembly that is combined into a single housing 80 that fits onto the canopy 46 of the mask assembly 16 and is attached to the mask assembly 16 such that the valve assembly 13 can be sealed to the mask assembly 16 with a single gasket 14 (FIG. 3) disposed on the planar portion 40. The valve assembly 13 has a breathing gas inlet 103 with a channel 109 to a demand type one-way inhalation valve 92. A portion of the incoming breathing gas is split off and provides a pressure source for the pressure compensated exhalation valve 95. The split-off portion of the incoming breathing gas provides a force for biasing the exhalation valve 95 in the closed position. The valve assembly 13 is described in greater detail below.

Figure 8:
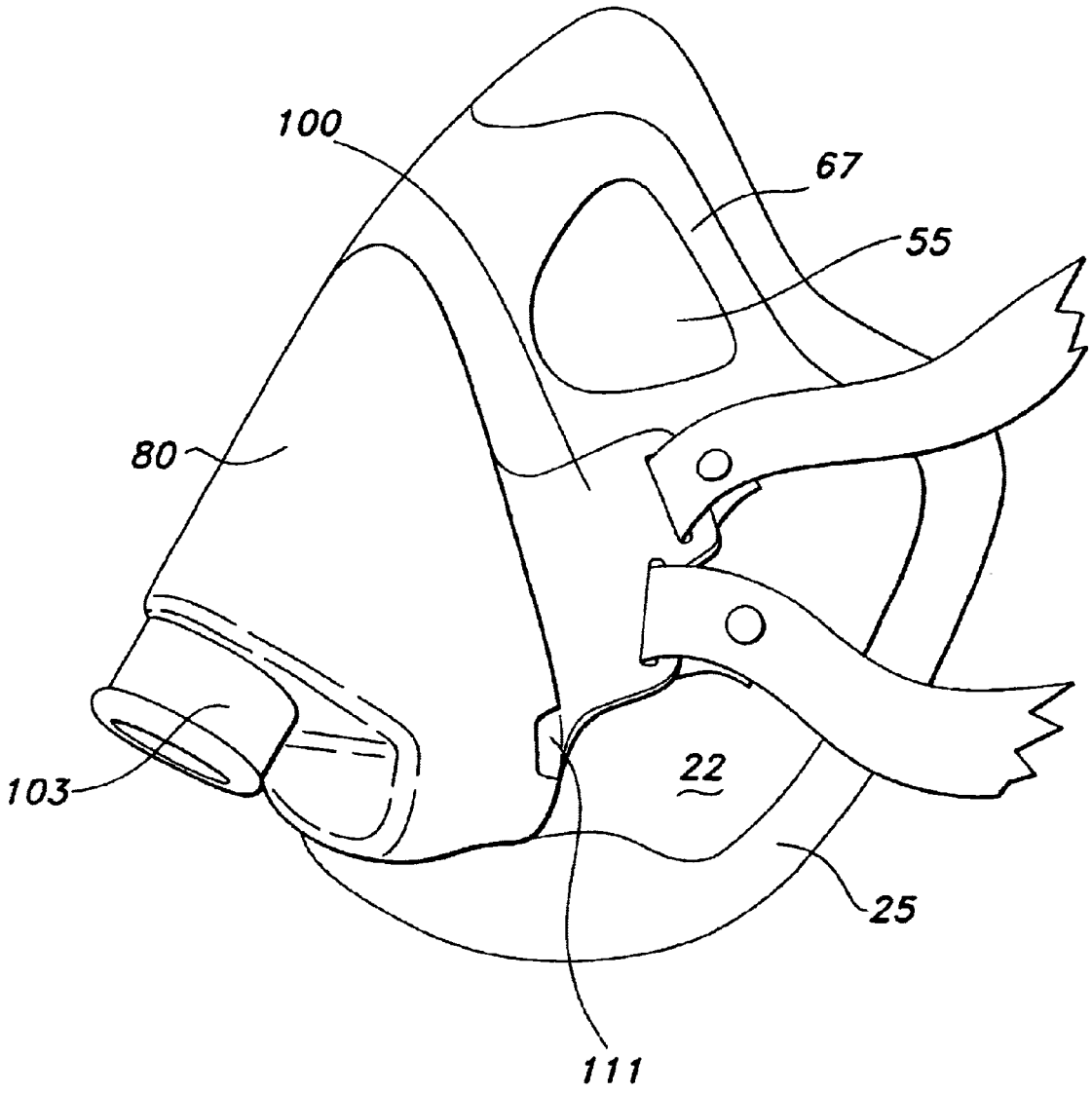
FIG. 8 is a perspective view of an alternate embodiment of the inhalation/exhalation valve assembly having an integrally formed tab in the housing for connecting to straps for holding the mask in position.

In FIG. 8, the housing 80 for the inhalation and exhalation valves 92, 95 is provided with an integrally formed tab 100 that can be connected to the straps 97 of a harness system (not shown) for extending about the head of the wearer and for supporting the mask assembly 16. The arrangement of the tab 100 to connect to the harness system provides the advantage that it further reduces the complexity of the mask assembly 16 because it does not require any strap mounts to be manufactured on the mask assembly 16. Accordingly, the tab 100 eliminates some parts from the mask assembly 16 which makes it easier to manufacture as part of a modular system. As an alternative, the tab 100 could be attached to the hardshell member 22 or the elastomeric material 25. It is known in the art to provide various harness systems for attaching masks to the head of the wearer. The mask of the present invention is readily adaptable for use with these harness systems. The harnesses may be connected directly to the housing 80 or to the mask 10, as described above, or may be connected to structures connected to the housing 80 or mask 10 as known to those of ordinary skill in the art.

Figure 9A:
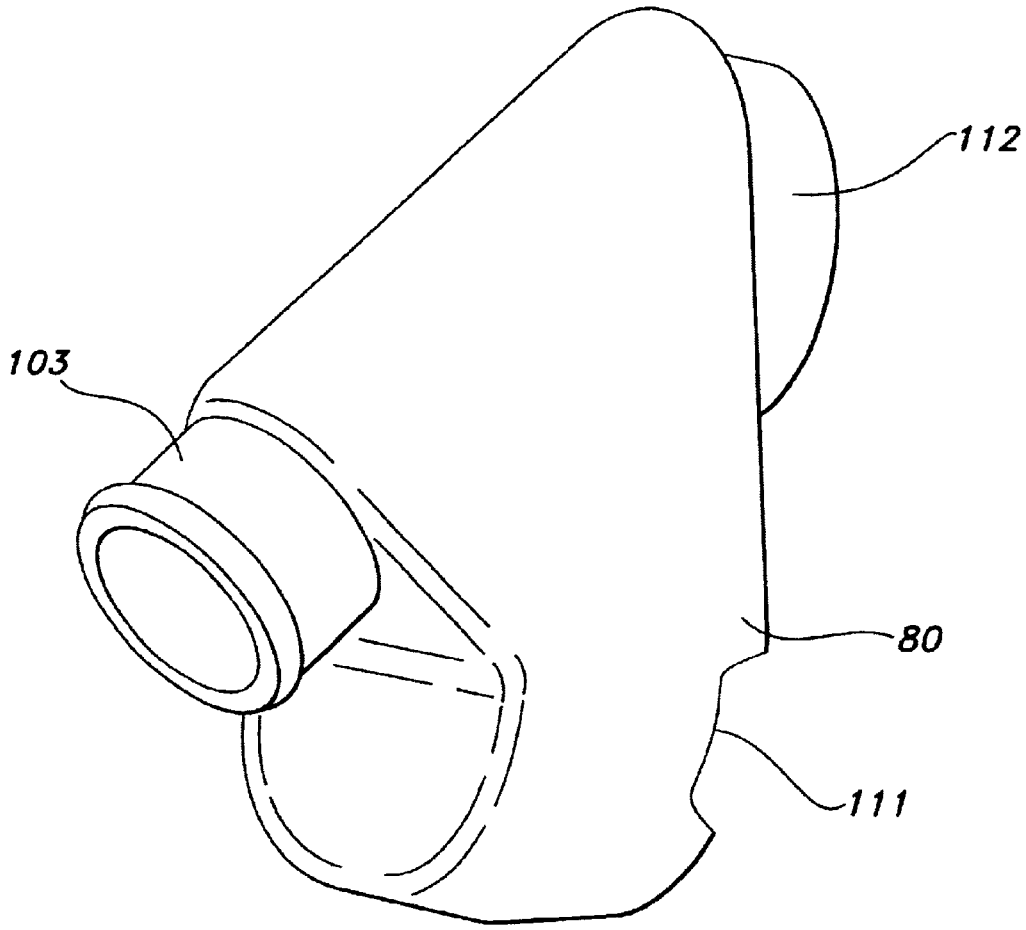
FIG. 9A is a perspective view of the exhalation/inhalation valve body.
Figure 9B:
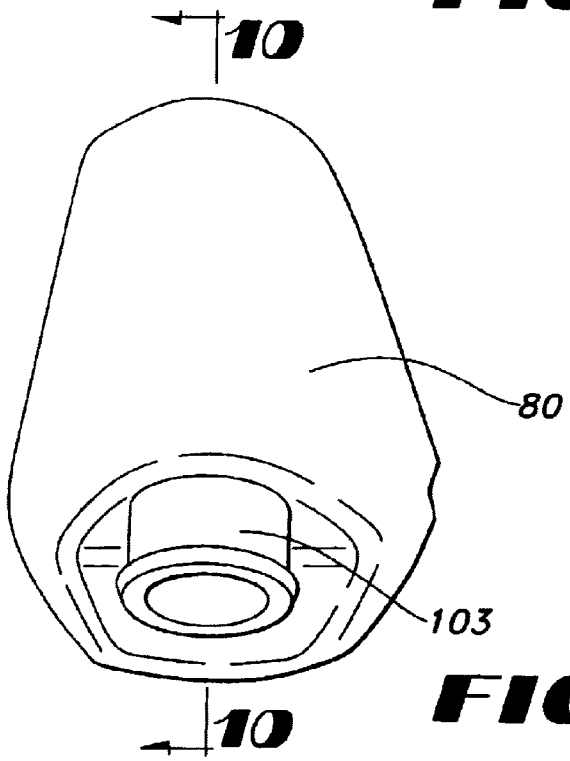
FIG. 9B is a front elevation view of the exhalation/inhalation valve body.

Turning to FIGS. 9A–9B, the inhalation/exhalation valve housing 80 is designed to be constructed of a single plastic body with one or more openings for breathing related and other passageways to the interior of the mask assembly 16. By arranging the inhalation and exhalation valves 92, 95 (FIG. 10) in a single plastic housing capable of attaching to the mask assembly 16 on a planar portion 40, the sealing of the mask assembly 16 and the valve assembly 13 is simplified. The housing 80 has an inlet 103 for the breathing gas mixture and an outlet 108 (FIG. 10) leading to an exhalation port 111 for exhalation.

Figure 10:
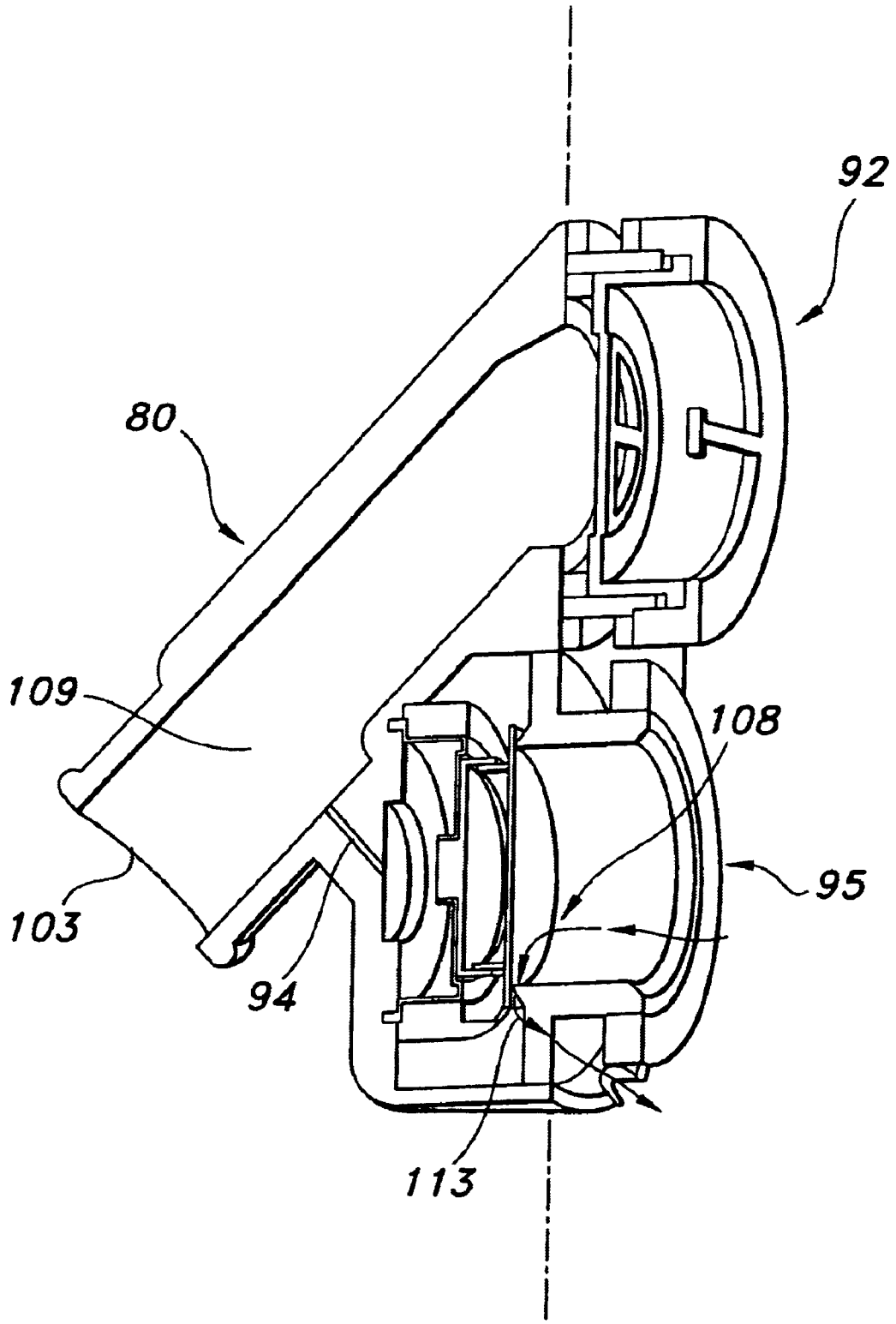
FIG. 10 is a sectional side view of the valve assembly taken along lines 10—10 of FIG. 9B.

One way inhalation valves 92 for receiving sources of pressurized breathing gases and pressure compensated exhalation valves 95 are generally known to those of ordinary skill in the art, and therefore the valve assembly 13 will be discussed briefly. As shown in FIG. 10, a main passageway 109 receives breathing gas under pressure from a source of pressurized breathing gas (not shown). The breathing gas flows until it fills up the inlet area outside the inhalation valve 92. A one way inhalation valve 92 provides for a demand system. When the wearer breathes in, the pressure on the opposite side of the inhalation valve 92 is reduced such that the valve opens. Breathing gas from the inlet area enters the breathing chamber until the pressure inside the chamber reaches a level sufficient to close the valve 92.

A portion of the inlet breathing gas is split off and passes through a connecting tube 94 that is directed to the outside of the one-way exhalation valve 95. The split-off pressurized breathing gas provides a force against the exhalation valve 95 that biases the valve 95 in the closed position. When the wearer of the mask exhales, the pressure generated by the wearer has to overcome the force of the diverted inlet gas in order to open the valve 95. When the exhalation pressure reaches a sufficient level, the valve 95 opens and the exhalation gases are released through the outlet 108 to the surrounding atmosphere.

The exhalation gases can be released in at least two ways. If the housing 80 for the valve assembly 13 is sealed along its entire periphery by the gasket 14 (FIG. 3), then an exhalation port 111 (FIGS. 1 and 9A) must be provided in the housing 80. As known to those of ordinary skill in the art, the exhalation port 111 preferably includes a one-way check valve and/or a mechanical guard to prevent debris and the like from entering the mask through port 111.

As an alternative, the housing 80 may be sealed to the mask assembly 16 around the valves 92 and 95 but not completely sealed around the periphery of the housing 80. In this manner a gap can be provided between the housing 80 and the mask assembly 16 below or around the exhalation valve 95 outside the mask assembly 16 such that the exhalation gases can escape through the gap after passing through the exhalation valve 95.

The housing 80 provides the mechanical guard to prevent debris from entering the mask 10 because of the torturous path that the exhalation gas travels from the exhalation valve through the gap between the valve housing 80 and the mask assembly 16. The pathway of the exhalation gases is shown by arrow 113 in FIG. 10.

The valves 92, 95 are disposed inside the housing 80 such that they are both capable of being sealed with the single gasket 14 along a single plane. The gasket 14 fits on the planar portion 40 of the mask assembly 16 as shown in FIG. 3. The inhalation valve 92 and exhalation valve 95 both extend into the canopy 46 and are attached by threaded members that fit inside the mask assembly 16 and attach to the portion of the valves that extends into the mask assembly 16 as described in detail below.

Figure 11:
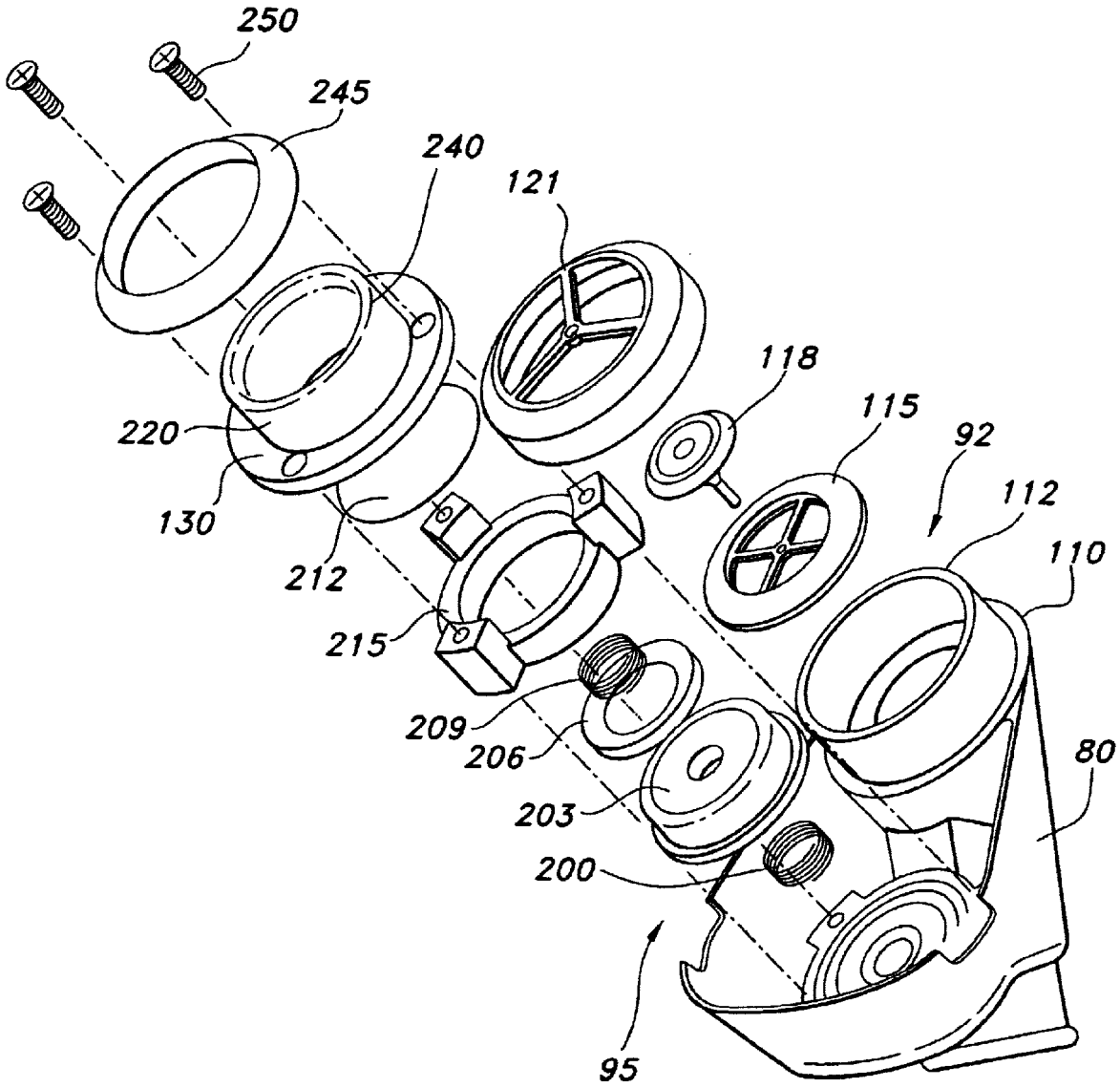
FIG. 11 is an exploded perspective view of the valve assembly.
Figure 12:
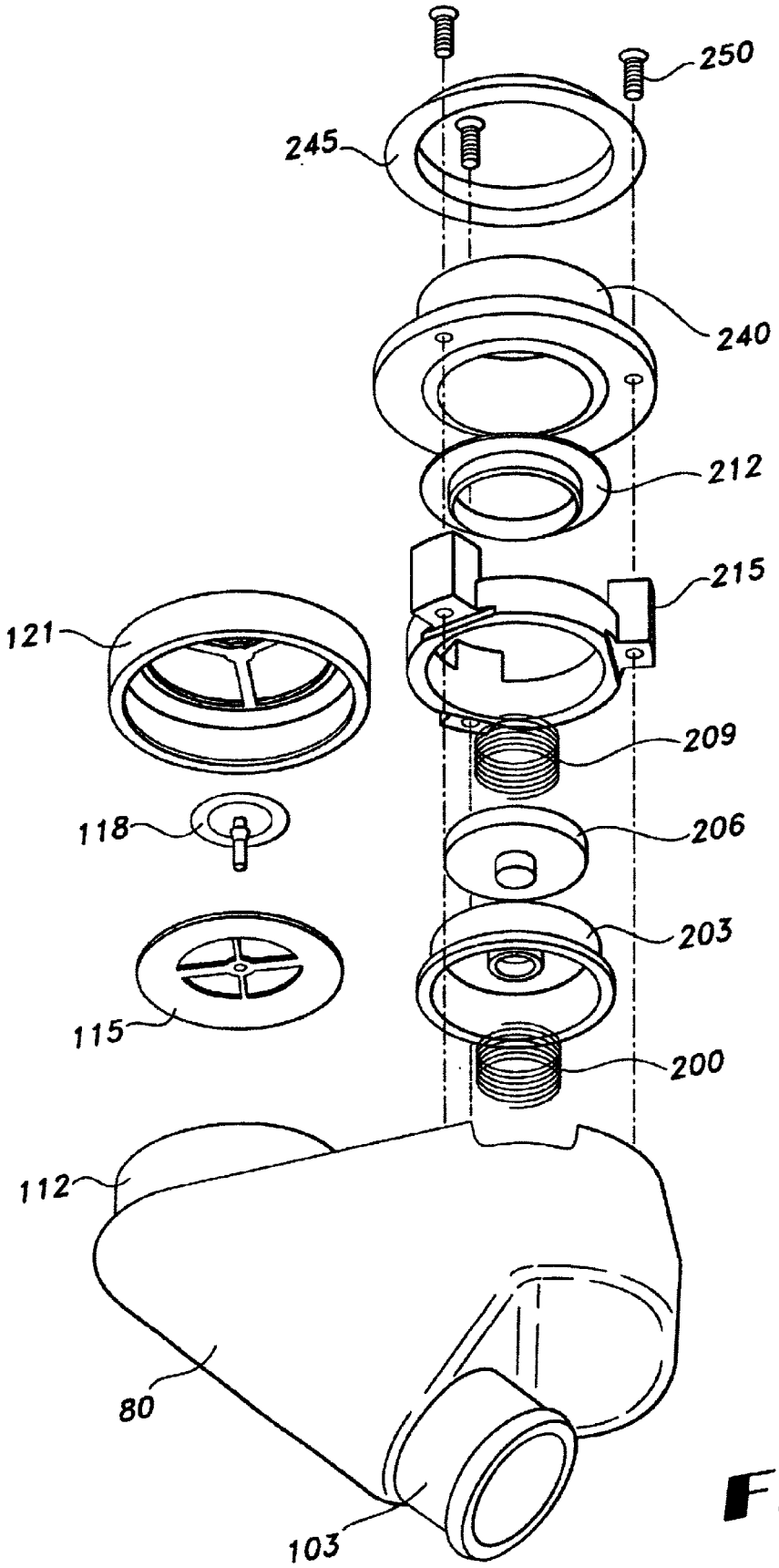
FIG. 12 is also an exploded perspective view of the valve assembly.

Turning to FIGS. 11–12, the housing 80 has a ledge 110 formed around a cylindrical hollow member 112 for the inhalation valve 92. The ledge 110 engages with the planar portion 40 (with gasket 14 disposed therebetween) such that the valve assembly 13 is sealed to the mask assembly 16. An inlet valve seat 115 carries a one way flapper valve 118. The inlet valve 92 is covered by a protective guard 121. The protective guard 121 is threaded such that it attaches to the cylindrical hollow member 112 on the inside of the mask assembly 16 such that the protective guard 121 secures the cylindrical hollow member 112 to the mask assembly 16.

The exhalation valve 95 is arranged such that a ledge 130 is established substantially coplanar with the ledge 110. The arrangement of the valves 92, 95 inside the housing 80 enables the valve assembly 13 to be sealed by the gasket 14 along a single plane.

The exhalation valve 95 includes a first coil spring 200 seated in the housing 80. A diaphragm 203 is disposed adjacent to the first spring 200. A spring cup 206 supports a second spring 209 that is disposed between the spring cup 206 and an exhalation plate 212. An exhalation support member 215 holds the springs 200, 209; the spring cup 206; and the exhalation plate 212 in alignment. An exhalation valve seat 220 that defines ledge 130 attaches to the exhalation support member 215 to hold the exhalation plate 212 in position in alignment with the other parts. A hollow cylindrical tube 240 is disposed on the exhalation valve seat 220 and extends into the mask assembly 16 when the valve assembly 13 is mounted on the mask assembly 16. A ring nut 245 attaches to the tube 240 on the inside of the mask assembly 16 by means of fasteners 250 to secure the valve assembly 13 to the mask assembly 16. The fasteners 250 extend through the ring nut 245, the exhalation valve seat 220, the exhalation support member 215 and into the housing 80 to maintain all of the parts in axial alignment. The exhalation valve 95 is a one-way valve that opens when the pressure exerted by the wearer during exhalation is applied to the exhalation plate 212 causing the diaphragm 203 to deflect and cause an opening that allows the air to escape through outlet 108 (FIG. 10) to atmosphere.

It is to be understood that the inhalation/exhalation valve assembly 13 is one form of service module. Other modules suitable for use with two or more conduits at least two of which are interconnected by one or more integral connecting passages would also be suitable. The service module of the present invention provides a single externally mounted module having two conduits and designed so as to provide for communication between the conduits.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A respiratory mask, comprising:

a hardshell member having a peripheral edge, the hardshell member having a pair of wings extending substantially along the contours of the face of the wearer from the peripheral edge along the cheeks of the wearer inward toward a central portion of the mask, the wings being disposed adjacent to a canopy where the hardshell member extends away from the face of the wearer to define a breathing chamber inside the mask; and, an elastomeric material attached to the hardshell member, the elastomeric material having a sealing edge for sealing the breathing chamber defined by the hardshell member, the sealing edge defined by a portion of the elastomeric material extending over the nose, around the sides of the mouth and across the mental protuberance of the wearer, the elastomeric material attached to an inside surface of the wings.

2. The respiratory mask of claim 1, wherein the mask terminates in an elastomeric material portion disposed around at least a portion of the peripheral edge of the hardshell member.

3. The respiratory mask of claim 1, wherein the elastomeric material is disposed along at least a portion of the peripheral edge of the hardshell so as to form an area of elastomeric material extending around the peripheral edge of the hardshell that is free of the hardshell and is disposed adjacent to the elastomeric material covered wings.

4. The respiratory mask of claim 1, wherein the elastomeric material is disposed along substantially the entire perimeter of the hardshell member.

5. The respiratory mask of claim 1, further comprising a rolled edge extending along the periphery of the hardshell member from one side to the other side of the mask and extending under the chin of the wearer.

6. The respiratory mask of claim 1, wherein the hardshell member includes an opening on opposite sides of the nose of the wearer.

7. The respiratory mask of claim 1, wherein the canopy is defined on one side by a planar surface having at least one opening defined therein.

8. The respiratory mask of claim 7, wherein the at least one opening is sized to be capable of receiving an inhalation/exhalation valve assembly.

9. The respiratory mask of claim 7, wherein the planar surface of the hardshell member has a first opening capable of receiving an inhalation valve and a second opening capable of receiving an exhalation valve.

10. The respiratory mask of claim 1, wherein the elastomeric material is attached to the hardshell member through chemical bonding.

11. A respiratory mask and service module combination, comprising:

a respiratory mask having a hardshell member defining a breathing cavity, the hardshell member having a substantially planar surface with a first opening and a second opening defined therein; and, a module capable of attaching to the mask such that a first passageway is aligned with the first opening and a second passageway is aligned with the second opening, the module mounted externally to the mask such that the passageways are capable of being sealed along the planar surface of the hardshell member.

12. The respiratory mask and service module combination of claim 11, further comprising a unitary housing enclosing the module.

13. The respiratory mask and service module combination of claim 12, wherein the unitary housing has side walls that align with the walls of the hardshell member to provide an aerodynamic surface.

14. The respiratory mask and service module combination of claim 12, wherein the housing attaches to the straps of a harness system.

15. The respiratory mask and service module combination of claim 11, wherein the planar surface is defined on one side of the hardshell member forming a canopy.

16. The respiratory mask and service module combination of claim 11, wherein inhalation and exhalation valves are arranged in the first and second passageways.

17. The respiratory mask and service module combination of claim 16, wherein the exhalation valve is a pressure-compensated exhalation valve.

18. The respiratory mask and service module combination of claim 11, wherein the first and second passageway are connected by a third passageway formed integrally in the module.

19. A method of forming a respiratory mask, comprising:

providing a respiratory mask having a hardshell member defining a breathing cavity, the hardshell member having a planar surface with a first opening and a second opening defined therein;

providing a module capable of attaching to the mask such that a first passageway is aligned with the first opening and a second passageway is aligned with the second opening, the module having at least one mounting shoulder capable of mounting on the planar surface externally to the mask such that the module is capable of being sealed along the planar surface of the respiratory mask; and, attaching the module to the respiratory mask.

20. The method of claim 19, wherein the module is disposed in a unitary housing.

21. The method of claim 20, wherein the unitary housing has side walls that align with the walls of the hardshell member to provide an aerodynamic surface.

22. The method of claim 19, wherein the planar surface is defined on one side of a hardshell member forming a canopy.

23. A respiratory mask, comprising:

a hardshell member having a peripheral edge, the hardshell member having a pair of wings extending substantially along the contour of the face of the wearer from the peripheral edge along the cheeks of the wearer inward toward a central portion of the mask, the wings being disposed adjacent to a canopy where the hardshell member extends away from the face of the wearer to define a breathing chamber inside the mask; and, an elastomeric material attached to the hardshell member, the elastomeric material having a sealing edge for sealing the breathing chamber defined by the hardshell member, the sealing edge defined by a portion of the elastomeric material extending over the nose, around the sides of the mouth and across the mental protuberance of the wearer, the elastomeric material attached to an inside surface of the wings and terminating in an elastomeric portion disposed around at least a portion of the peripheral edge of the hardshell member so as to form an area of elastomeric material that is disposed adjacent to the elastomeric material covered wings, the elastomeric portion terminating in a rolled edge extending from one side to the other side of the mask and extending under the chin of the wearer.

24. A respiratory mask and service module combination comprising:

a respiratory mask having a hardshell member forming a breathing cavity with a planar surface having at least one opening defined therein;

a module having at least one conduit for inhalation of a breathing gas extending to the breathing cavity and in fluid communication therewith and having at least one conduit for exhalation extending to the breathing cavity and in fluid communication therewith, the first and second conduit being connected by a passageway between the conduits such that a portion of the breathing gas from the inhalation conduit provides a medium for a pressure compensated exhalation valve, the module mounted externally to the mask such that the conduits are capable of being sealed along the planar surface of the hardshell member; and, a unitary planar gasket disposed between the module and the hardshell member on an outside surface of the hardshell member.

25. A respiratory mask and service module combination, comprising:

a respiratory mask having a hardshell member defining a breathing cavity, the hardshell member having a substantially planar surface with a first opening and a second opening;

an elastomeric material attached to the hardshell member, the elastomeric material having a sealing edge for sealing the breathing chamber defined by the hardshell member, the sealing edge defined by a portion of the elastomeric material extending over the nose, around the sides of the mouth and across the mental protuberance of the wearer; and, a module capable of attaching to the mask such that a first passageway is aligned with the first opening and a second passageway is aligned with the second opening, the module mounted externally to the mask such that the passageways are capable of being sealed along the planar surface of the hardshell member.

26. The respiratory mask and service module combination of claim 25 wherein the first and second passageways are connected by a third passageway.

27. The respiratory mask and service module combination of claim 25, wherein the first and second passageways include first and second conduits capable of engaging with locking members disposed inside the mask.

28. The respiratory mask and service module combination of claim 27, wherein the first and second conduits have a set of threads disposed thereon for engaging with the locking members.

29. The respiratory mask and service module combination of claim 25, wherein the hardshell member further comprises a pair of wings extending substantially along the contours of the face of the wearer from a peripheral edge along the cheeks of the wearer inward toward a central portion of the mask, the wings being disposed adjacent to a canopy where the hardshell member extends away from the face of the wearer to define the breathing chamber, the elastomeric material attached to an inside surface of the wings.

* * * * *